US005217393A

United States Patent [19]

Del Negro et al.

[11] Patent Number: 5,217,393

[45] Date of Patent: Jun. 8, 1993

[54] MULTI-FIT COAXIAL CABLE CONNECTOR

[75] Inventors: James J. Del Negro, Horseheads; Bruce C. Hauver, Elmira, both of N.Y.

[73] Assignee: Augat Inc., Mansfield, Mass.

[21] Appl. No.: 950,099

[22] Filed: Sep. 23, 1992

[51] Int. Cl.[5] ..... H01R 9/07

[52] U.S. Cl. ..... 439/585; 439/877

[58] Field of Search ..... 439/578-585, 439/675, 877-882

[56] References Cited

U.S. PATENT DOCUMENTS

| | | | |
|---|---|---|---|
| 3,363,222 | 1/1968 | Karol . | |
| 4,400,050 | 8/1983 | Hayward | 439/585 |
| 4,684,201 | 8/1987 | Hutter | 439/585 |
| 4,755,152 | 7/1988 | Elliot et al. | 439/585 |
| 4,806,116 | 2/1989 | Ackerman | 439/304 |
| 4,990,106 | 2/1991 | Szegda | 439/585 |
| 5,073,129 | 12/1991 | Szegda | 439/585 |
| 5,083,943 | 1/1992 | Torrant | 439/585 |

*Primary Examiner*—David L. Pirlot

*Attorney, Agent, or Firm*—Weingarten, Schurgin, Gagnebin & Hayes

[57] ABSTRACT

A crimp type F-Connector wherein the crimp required for easy installation reduced while affording reliable cable retention. A wide range of cable sizes are accommodated by one connector which is configured to provide adequate sealing and mechanical strength in the connector while facilitating optimized radial deformation for providing reliable retention and a reliable mechanical and electrical interface with the coaxial cable upon which it is crimped. The connector includes a crimping portion including a sleeve that has a plurality of ribs or external annular protrusions which are dimensioned to enhance rigidity and mechanical strength. The ribs are of equal diameters when uncrimped and are "flat" crimped to maximize the cable area against which crimp forces are applied. An innermost rib is proximate to a support wall and separated by an exaggerated spacing to reduce crimp forces experienced when installing the connector onto the cable.

4 Claims, 3 Drawing Sheets

MULTI-FIT COAXIAL CABLE CONNECTOR

FIELD OF THE INVENTION

The present invention relates to electrical connectors, and in particular, to connectors for connecting coaxial cable ends to ports or terminals on electrical equipment.

BACKGROUND OF THE INVENTION

Coaxial cable end connectors are known for connecting the ends of coaxial cable to electrical equipment, such as cable television equipment. Crimp type "F-connectors", provide electrical and mechanical connection between a transmission line, i.e., coaxial cable and ports or terminals on the electrical equipment. Such connectors in their various permutations, as described in U.S. Pat. Nos. 4,490,106 and 5,073,129 to Szegda and U.S. Pat. No. 4,755,152 to Elliot and as illustrated in FIGS. 1A and 1B, must be configured to provide adequate sealing and secure mechanical engagement with the coaxial cable upon which they are crimped or installed, while being easily installable thereon. Relatively minor changes in the dimensions and configuration of crimp type F-connectors can significantly impact on the retention of the connector on the cable onto which it is crimped, and the reliability and electrical performance of the interface between the connector and the cable. Furthermore, it is desirable to configure crimp type F-connectors so that one particular configuration can be reliably crimped onto a wide range of diameters of coaxial cable.

Known F-connectors suffer a disadvantage in that the range of cable sizes onto which they can be crimped and is significantly limited by a limited radial deformation which can be imparted to the connector configuration during crimping Additionally, known connectors disadvantageously require large forces to be exerted on the connector configuration to impart optimal radial deformation. Failure or inability to exert the necessary forces during crimping compromises the integrity of the electrical and mechanical engagement between the connector and cable.

Typically, crimp type F-connectors are installed onto coaxial cable by effecting radial deformation of a crimping portion 10 (FIGS. 1A and 1B) by exerting forces thereon using a crimping tool. Multiple crimping tools are required in certain circumstances for crimping where numerous connectors are necessary to accommodate various sizes of cable. Further, various forces may be required to impart optimal radial deformation to effect reliable retention of the various connectors on the cables.

Known F-connectors are often unreliably installed due to difficulties associated with exerting optimal forces during crimping. Even where a "universal" connector is installable on a range of cable sizes using a single crimp tool, differences in the forces exerted to effect radial deformation can negatively impact the reliability of the connection and the retention of the connector on the cable. Significant difficulties arise with the reliability and retention of connectors that require the exertion of large forces for crimping. Crimp tool tolerance problems and installer fatigue exacerbate the problems associated with exerting optimal forces to assure optimal radial deformation during crimping.

SUMMARY OF THE INVENTION

The present invention provides a crimp type F-Connector wherein the optimal forces required for easy and reliable installation and retention are significantly reduced. A wide range of cable sizes are accommodated by one connector which is configured to provide adequate sealing and mechanical strength in the connector while facilitating optimized radial deformation for providing reliable retention and a reliable mechanical and electrical interface with the coaxial cable upon which it is crimped.

An illustrative embodiment includes a crimping portion comprising a sleeve that has a plurality of ribs or external annular protrusions and preferably three ribs as shown and described hereinafter. The ribs are dimensioned having a minimum dimension relative to a total outside diameter of a crimp portion of the connector, to enhance rigidity and mechanical strength. The ribs are of equal height uncrimped and are "flat" crimped, without any "taper", to maximize the cable area against which crimp forces are applied. An innermost rib is proximate to a support wall and separated by an exaggerated spacing therebetween. The number of ribs and the extent of the spacing are selected to optimize radial deformation while providing an adequate seal. The exaggerated spacing reduces the required crimp force and consequent stress put on the connector during installation.

Features of the invention include provision of a family of multi-fit crimp F-connectors wherein two connectors accommodate coaxial cable for all F-fit interconnection applications.

A single crimping tool is used to install a number of connectors in a family by providing all such family members with a common rib outside diameter. Further features include a minimization of installer fatigue because of the reduction in force required for installation/crimping. Greater reliability of interconnection is also achieved.

BRIEF DESCRIPTION OF THE DRAWINGS

Other features and benefits of the invention can be more clearly understood with reference to the specification and the accompanying drawings in which.

DETAILED DESCRIPTION

Figure 1A:
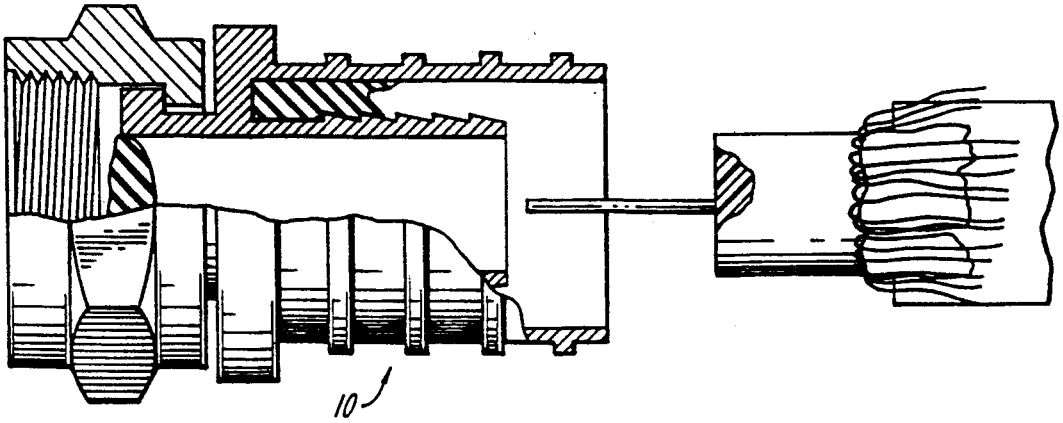
FIG. 1A (PRIOR ART)
FIG. 1A is a cut-away view partially in section of a prior art F-Connector.
Figure 1B:
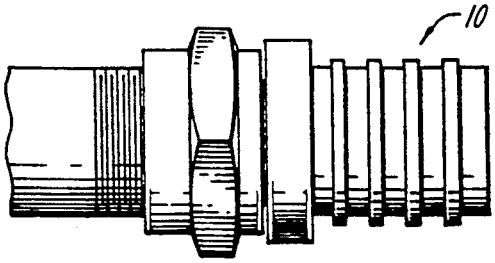
FIG. 1B (PRIOR ART)
FIG. 1B is a plan view of a prior art F-Connector.
Figure 2A:
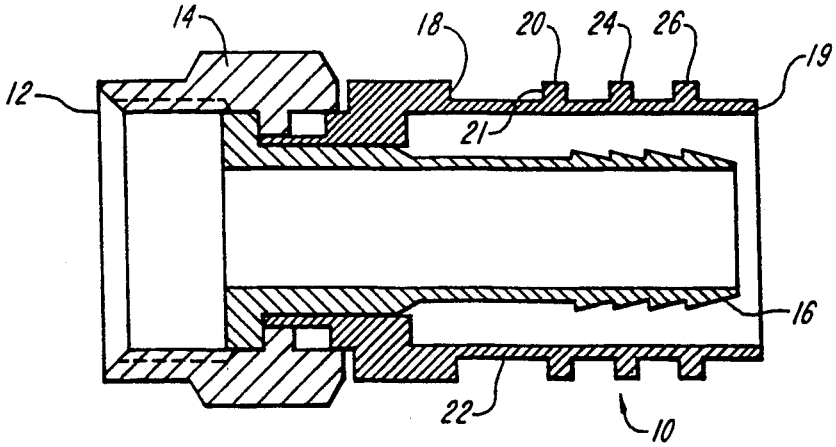
FIG. 2A is a sectional view of an illustrative embodiment of an F-Connector in accordance with the invention.
Figure 2B:
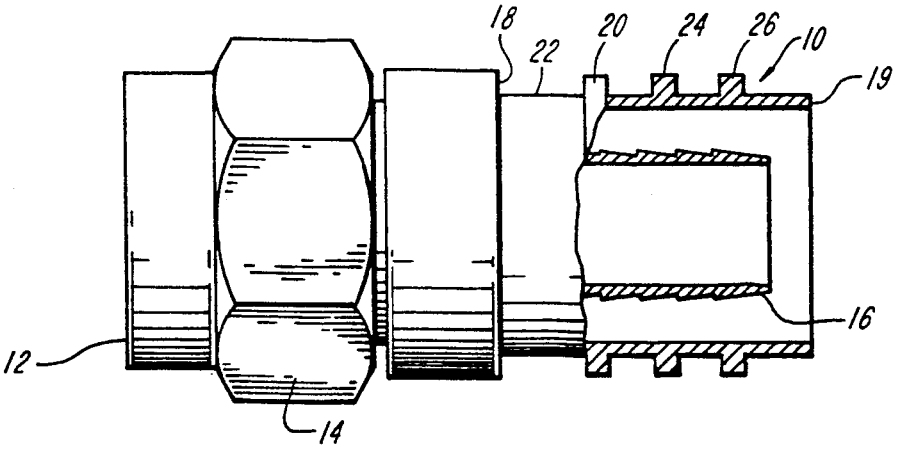
FIG. 2B is a cut-away view partially in section of the F-Connector of FIG. 2A.
Figure 2C:
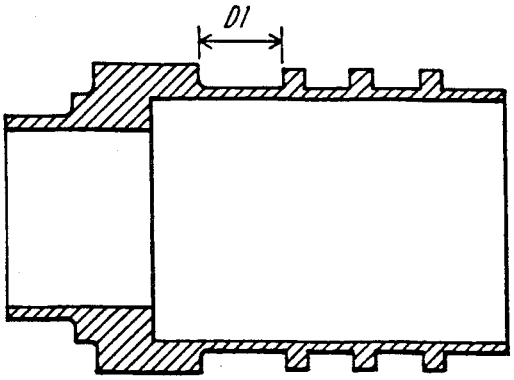
FIG. 2C is a sectional view of the F-Connector of FIG. 2A including dimensions therefor.

Referring now to FIGS. 2A–2C, an illustrative embodiment of a crimp type F-connector comprises a crimp portion 10 which engages a standard female interface 12 and includes a hex nut portion 14 for installing the connector on a male interface post or terminal as known in the art. Interior to the crimp portion 10, is a post 16 having barbs or serrations disposed thereon.

The crimp portion 10 includes a sleeve having a support wall 18 proximate to a first end and a cable receiving end 19 disposed distally with respect thereto. A plurality of ribs or annular protrusions are disposed on the exterior of the crimp portion 10. An innermost rib 20 is disposed adjacent to the support wall 18 and is separated therefrom by an exaggerated spacing 22 dimensioned as discussed hereinafter. The plurality of ribs in this illustrative embodiment includes an intermediate rib 24 and an outermost rib 26 disposed proximate to the cable receiving end 19. The innermost rib 20 and the outermost rib 26 are equidistant from a center line of the intermediate rib 24.

The exaggerated spacing 22 between the support wall 18 and the innermost rib 20 is a spacing which is greater than each of the distances between the intermediate rib 24 and the innermost and outermost ribs 20, 26. The spacing 22 is selected as a function of the length of the sleeve between the support wall 18 and the cable receiving end 19. The dimension of the exaggerated spacing facilitates a reduction in the force required to crimp the connector onto a cable. The reduction in force applied during crimping, results in less physical stress on the connector, a more durable, higher integrity connection, and less fatigue for the crimp tool operator who may need to make repeated crimp connections.

In the illustrative embodiment of FIGS. 2A–2C, the exaggerated spacing 22 is dimensioned according to a preferred ratio of the distance between the support wall 18 and an opposing edge 21 of the innermost rib 20, relative to the length of the sleeve between the support wall 18 and the cable receiving end 19. Such ratio illustrated using the dimensions of FIG. 2C is as follows:

$$\frac{\text{exaggerated spacing}}{\text{sleeve length from wall}} \rightarrow \frac{0.120}{0.425} = 0.28 \approx 25\%$$

Thus, the preferred spacing, i.e., exaggerated spacing, between the support wall 18 and the opposing edge 21 of the innermost rib 20 is approximately 25% or one-quarter of the distance from the support wall 18 to the cable receiving end 19.

The ribs 20, 24, 26 are preferably and advantageously minimized in number and dimensioned so that a single crimping tool can be used for a plurality or family of F-connectors in applications on a range of coaxial cable sizes. In the embodiments illustrated in FIGS. 2A–3C, only two connectors are required in the family for use with coaxial cable ranging from 0.240" to 0.300" outer diameter. The connector illustrated in FIGS. 2A–2C accommodates larger cables having outer diameters from 0.272" (standard coaxial cable) to 0.300" (quad shield cable). The connector illustrated in FIGS. 3A–3C accommodates smaller cables ranging from 0.240" (standard) to 0.266" (quad shield).

In the case of either connector in the family, the outer diameter of the ribs, in an uncrimped state, is selected to be 0.432", which in both cases is accommodated by a single crimping tool. In the illustrative embodiment, a flat crimp is implemented whereby the ribs 20, 24, 26 all start having the same outer diameter. Subsequent to crimping into a hexagonal configuration, all the ribs are hexagonally shaped and of substantially equal dimensions (not shown). The resultant flat crimped ribs exert substantially equal forces in engaging the cable against the barbs on the interior post 16. Unlike "tapered" F-connector implementations known in the art, the flat crimp configuration facilitated by the crimp portion 10 described herein, applies substantially uniform forces and maximizes the cable surface area against which such forces are applied, resulting in enhanced engagement of the coaxial cable within the connector.

Additionally, the rib configuration illustrated and described herein incorporates rib dimensioning considerations which add rigidity to the crimp portion 10. The ribs 20, 24, 26 are preferably dimensioned with respect to the sleeve of the crimp portion 10 such that a preferred ratio therebetween is obtained. Specifically, such ratio, illustrated using the dimensions of FIG. 2C is as follows:

$$\frac{\text{rib height}}{\text{total outside diameter}} \rightarrow \frac{0.432 - 0.373}{0.432} = 0.136 \approx 10\%$$

Thus, the rib height is preferably minimally 10% of the total outside diameter of the crimp portion 10 (including ribs), to enhance the rigidity of the crimp portion and thereby enhance engagement of the coaxial cable within the connector.

Figure 3A:
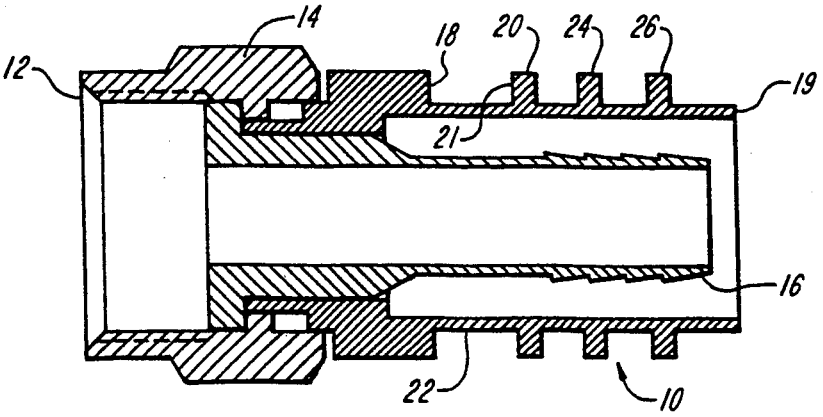
FIG. 3A is a sectional view of another illustrative embodiment of an F-Connector in accordance with the present invention.
Figure 3B:
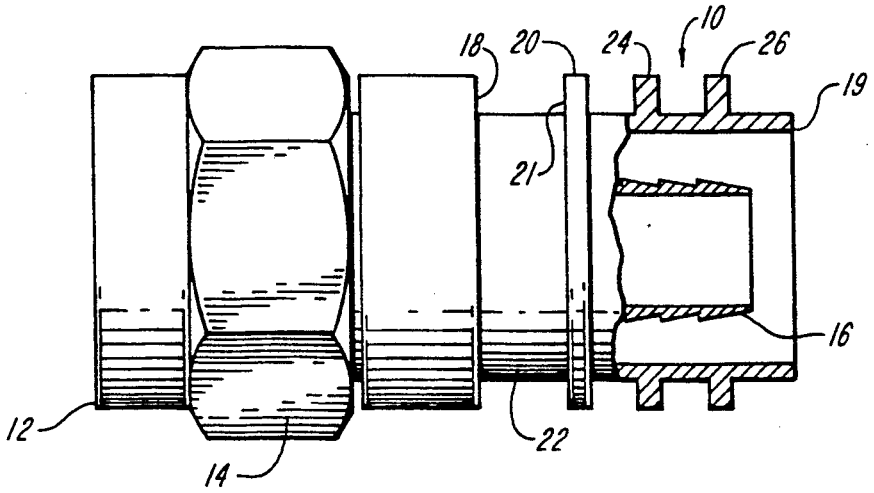
FIG. 3B is a cut-away view partially in section of the F-Connector of FIG. 3A.
Figure 3C:
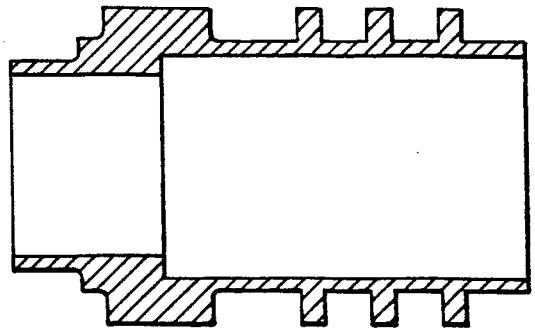
FIG. 3C is a sectional view of the F-Connector of FIG. 3A including dimensions therefor.

Although particular dimensions are referred to herein with respect to the illustrative embodiment in FIGS. 2A–2C, it will be appreciated that other dimensions, depending upon the scale of the connector, and consistent with the above referred ratios, such as those illustrated in FIGS. 3A–3C can be implemented according to the ratios and in accordance with the considerations of the invention described hereinbefore.

While a connector "family" is described wherein two connectors accommodate coaxial cable diameters ranging from 0.240" to 0.300", it will be appreciated by those of ordinary skill in the art that any number of connectors incorporating the concepts according to the invention can be implemented to accommodate various other ranges or sizes of coaxial cable.

Although the illustrative embodiments herein are described as having three ribs, it will be appreciated that connectors can be implemented according to the invention having fewer ribs.

Although the invention has been shown and described with respect to exemplary embodiments thereof, various other changes, omissions and additions in form and detail thereof may be made therein without departing from the spirit and scope of the invention.

What is claimed is:

1. A coaxial cable end connector comprising:

an outer sleeve having an outer surface with an outer sleeve outer diameter and an outer sleeve inner surface with an outer sleeve inner diameter, said outer sleeve having a cable receiving end and a post connection end, said outer sleeve including a support portion adjacent the post connection end, said support portion having an outer surface and having a support portion wall extending between said support portion outer surface and said outer sleeve outer surface, said outer sleeve having a plurality of axially spaced ribs extending annularly from said outer surface of said outer sleeve, each of said plurality of axially spaced ribs having respective rib diameters, said plurality of axially spaced ribs including an outermost rib adjacent the cable receiving end of said outer sleeve and an innermost rib having an inner edge adjacent to and spaced from said support portion wall, one of said plurality of ribs having a largest rib diameter, said outer sleeve having a first sleeve portion of a first length extending from said support portion wall to said inner edge of said innermost rib and a second sleeve portion of a second length extending from said support portion wall to said cable receiving end of said outer sleeve;

the difference between said largest rib diameter and said outer sleeve outer diameter divided by said largest rib diameter being a ratio of at least 0.10;

said first length divided by said second length being a ratio of at least 0.25.

2. The coaxial cable end connector of claim 1 wherein each of said respective rib diameters being equal.

3. The coaxial cable end connector of claim 1 wherein the outermost rib has a width and an outer edge, and said outer edge is spaced from said cable receiving end of said outer sleeve by at least the width of the outermost rib.

4. The coaxial cable end connector of claim 1 wherein said outer sleeve has three ribs.

* * * * *

UNITED STATES PATENT AND TRADEMARK OFFICE

CERTIFICATE OF CORRECTION

PATENT NO. : 5,217,393

DATED : June 8, 1993

INVENTOR(S) : James J. Del Negro, et al.

It is certified that error appears in the above-indentified patent and that said Letters Patent is hereby corrected as shown below:

In the Abstract, line 1, "crimp required" should read --crimp forces required--.

Column 1, line 38, "crimping Additionally" should read --crimping. Additionally--.

Signed and Sealed this

Third Day of May, 1994

Bruce Lehman

*Attest:*

BRUCE LEHMAN

*Attesting Officer*

*Commissioner of Patents and Trademarks*